US010632606B1

(12) United States Patent
Wang

(10) Patent No.: US 10,632,606 B1
(45) Date of Patent: Apr. 28, 2020

(54) SOCKET HOLDER AND SOCKET RACK INCLUDING THE SAME

(71) Applicant: Dexing Precision Co., Ltd., Taichung (TW)

(72) Inventor: Chen-Hui Wang, Taichung (TW)

(73) Assignee: DEXING PRECISION CO., LTD., Taichung (TW)

( * ) Notice: Subject to any disclaimer, the term of this patent is extended or adjusted under 35 U.S.C. 154(b) by 0 days.

(21) Appl. No.: 16/390,861

(22) Filed: Apr. 22, 2019

(51) Int. Cl.
*B25H 3/00* (2006.01)
*B25H 3/04* (2006.01)
*B25B 13/06* (2006.01)

(52) U.S. Cl.
CPC ..... *B25H 3/003* (2013.01); *B25H 3/006* (2013.01); *B25H 3/04* (2013.01); *B25B 13/06* (2013.01)

(58) Field of Classification Search
CPC ..... B25H 3/06; B25H 3/003; B25H 3/006; B25H 3/04; B25B 13/06
USPC ..... 211/70.6; 206/378, 377–376, 373, 375, 206/372, 493
See application file for complete search history.

(56) References Cited

U.S. PATENT DOCUMENTS 1,712,473 A * 5/1929 McWethy ..... B25H 3/003 206/378
5,467,874 A * 11/1995 Whitaker ..... B25B 23/0035 206/378
6,168,018 B1 * 1/2001 Ramsey ..... B25H 3/06 206/378
6,698,600 B1 * 3/2004 Lee ..... B25H 3/003 206/378
6,712,225 B2 * 3/2004 McNeely ..... B25H 3/003 206/378
6,991,105 B2 * 1/2006 Winnard ..... B25H 3/003 206/378
7,264,213 B2 * 9/2007 Liu ..... A47F 5/0006 206/378
9,782,890 B2 * 10/2017 Hsieh ..... B25H 3/04
10,130,194 B1 * 11/2018 Lai ..... A47F 5/0006
10,421,175 B2 * 9/2019 Chou ..... B25H 3/04
2003/0150824 A1 * 8/2003 McNeely ..... B25H 3/003 211/70.6
2006/0254940 A1 * 11/2006 Mu ..... B25H 3/003 206/378
2009/0200190 A1 * 8/2009 Hsieh ..... B25H 3/003 206/378

* cited by examiner

*Primary Examiner* — Chun Hoi Cheung
(74) *Attorney, Agent, or Firm* — Muncy, Geissler, Olds & Lowe, P.C.

(57) ABSTRACT

A socket holder is provided, including: a seat, a sleeve member and a restricting mechanism. The sleeve member is movably assembled with the seat. The restricting mechanism includes at least one first restricting portion and at least one second restricting portion which is movable relative to and engaged with the at least one first restricting portion. When the seat and the sleeve member move relative to each other in an axial direction, the second restricting portion unidirectionally moves along a cycling path relative to the first restricting portion, and the at least one second restricting portion is restricted in a releasing position or a locking position. A socket rack including at least one of the socket holder described above is further provided and further includes: a sliding rail on which the at least one socket holder is slidably disposed.

11 Claims, 11 Drawing Sheets

SOCKET HOLDER AND SOCKET RACK INCLUDING THE SAME

BACKGROUND OF THE INVENTION

Field of the Invention

The present invention relates to a socket holder and a socket rack including the same.

Description of the Prior Art

Generally, for easy carrying, socket storage is carried out by disposing a socket into a receiving hole or on a socket seat of a tool rack. A conventional socket holder is engaged with the socket by a detent ball, and an operator has to firmly hold the tool rack and pull up the socket, which is inconvenient when there is oil on the operator's hands or the socket. In addition, it is unable to confirm whether the socket is stably locked on the socket holder, which can cause disengagement of the socket from the socket holder. Furthermore, a sleeving portion and a connecting portion of the conventional socket holder are usually integrally made in one piece, which is inconvenient to maintain when the socket holder is partially broken.

The present invention is, therefore, arisen to obviate or at least mitigate the above-mentioned disadvantages.

SUMMARY OF THE INVENTION

The main object of the present invention is to provide a socket holder and a socket rack including the same, and the socket holder can be easily operated to assemble or disassemble with a socket.

To achieve the above and other objects, the present invention provides a socket holder, including: a seat; a sleeve member and a restricting mechanism. The sleeve member is movably assembled with the seat. The restricting mechanism includes at least one first restricting portion and at least one second restricting portion which is movable relative to and positionably engaged with the at least one first restricting portion. One of the at least one first restricting portion and the at least one second restricting portion is disposed on the seat and the other is disposed on the sleeve member. When the seat and the sleeve member move relative to each other in an axial direction, the at least one second restricting portion moves along a cycling path relative to the at least one first restricting portion, and the at least one second restricting portion is restricted in a releasing position or a locking position.

To achieve the above and other objects, the present invention further provides a socket rack, including at least one socket holder as described above. The socket rack further includes a sliding rail on which the at least one socket holder is slidably disposed.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
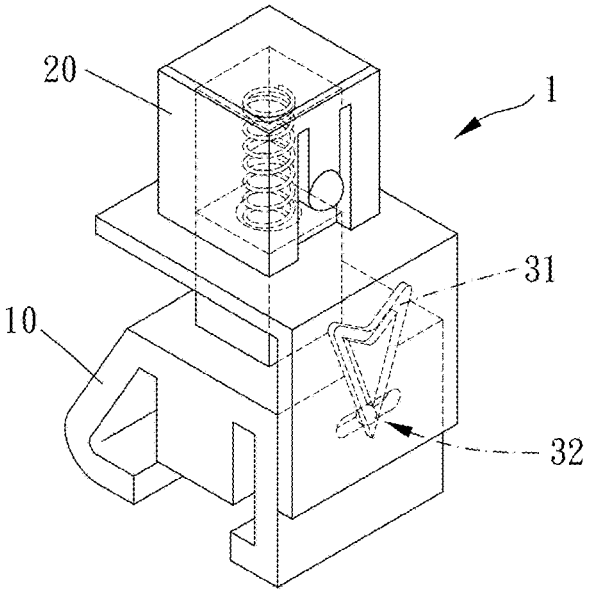
FIGS. 1 to 3 are schematic diagrams of a first preferable embodiment of the present invention in operation.
Figure 2:
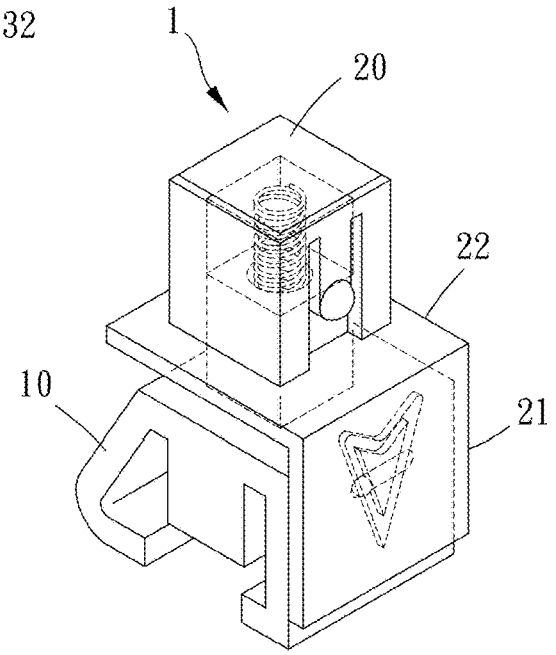
Figure 3:
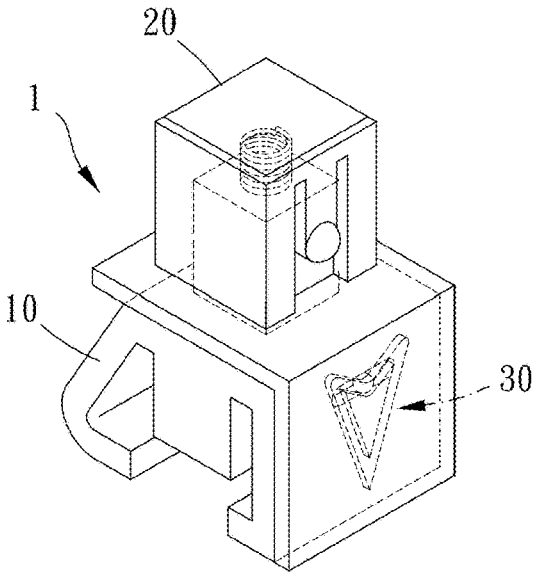
Figure 5:
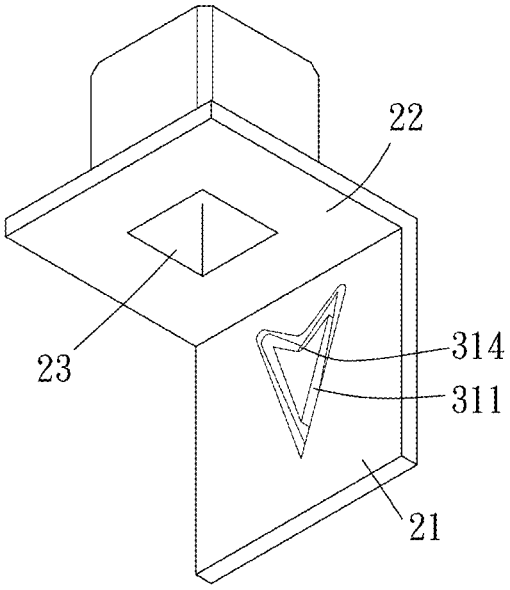
FIG. 5 is a stereogram of a sleeve member of FIG. 4.
Figure 4:
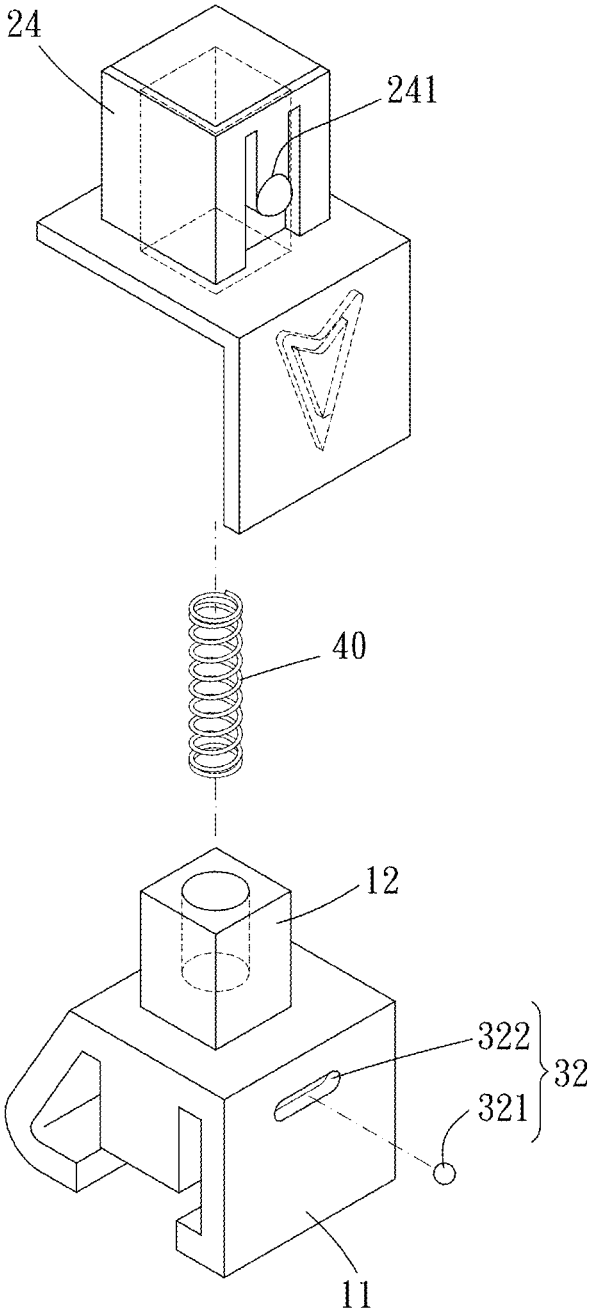
FIG. 4 is a breakdown drawing of the first preferable embodiment of the present invention.
Figure 6:
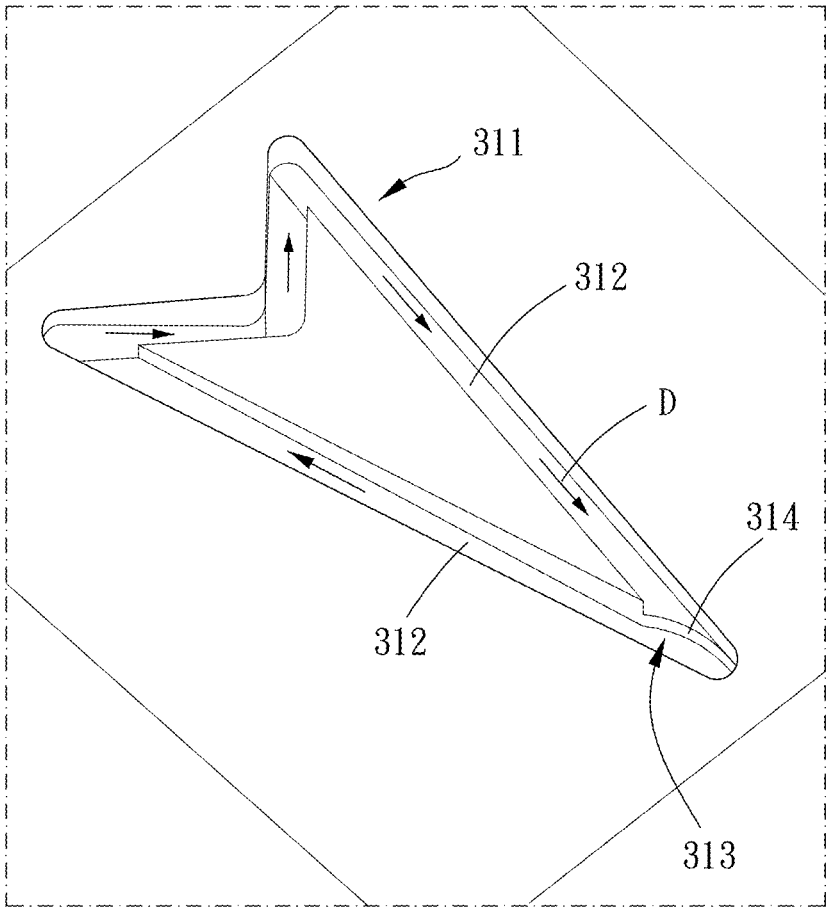
FIG. 6 is a partial enlargement of a sleeve member of the first preferable embodiment of the present invention.
Figure 7:
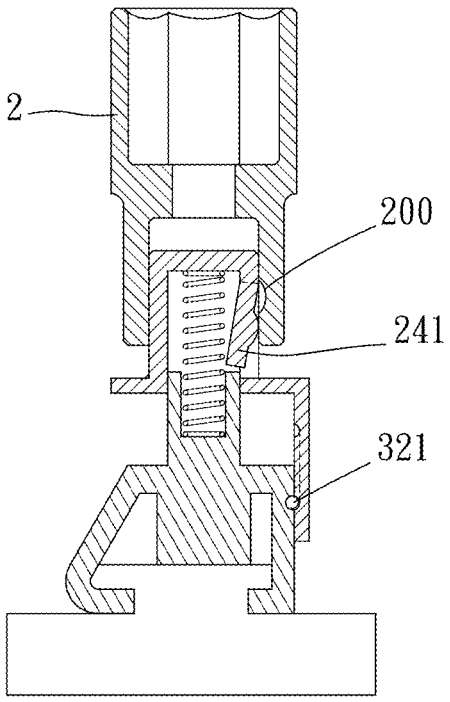
FIG. 7 is a cross-sectional view of the first preferable embodiment of the present invention in a releasing position.
Figure 8:
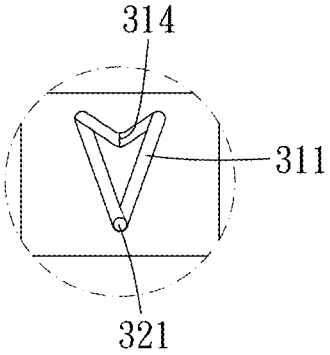
FIG. 8 is a state diagram of a restricting mechanism of FIG. 7.
Figure 9:
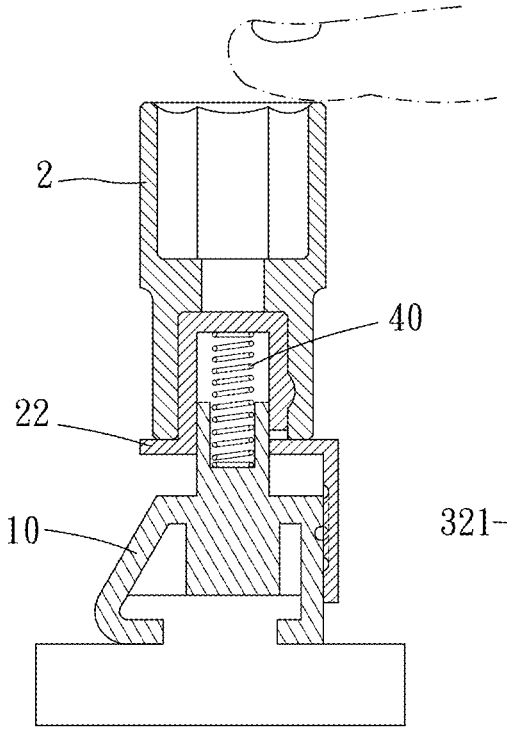
FIG. 9 is a cross-sectional view of the first preferable embodiment of the present invention in operation.
Figure 10:
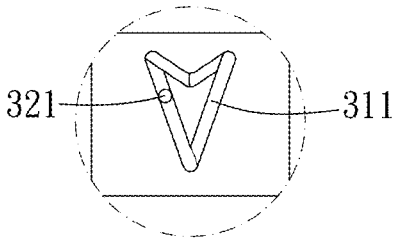
FIG. 10 is a state diagram of a restricting mechanism of FIG. 9.

Please refer to FIGS. 1 to 13 for a first preferable embodiment of the present invention. A socket holder 1 of the present invention includes a seat 10, a sleeve member 20 and a restricting mechanism 30.

The sleeve member 20 is movably assembled with the seat 10. The restricting mechanism 30 includes at least one first restricting portion 31 and at least one second restricting portion 32 which is movable relative to and positionably engaged with the at least one first restricting portion 31. One of the at least one first restricting portion 31 and the at least one second restricting portion 32 is disposed on the seat 10 and the other is disposed on the sleeve member 20. When the seat 10 and the sleeve member 20 move relative to each other in an axial direction, the at least one second restricting portion 32 moves along a cycling path relative to the at least one first restricting portion 31, and the at least one second restricting portion 32 is restricted in a releasing position or a locking position. The axial direction is a direction that the seat 10 and the sleeve member 20 move relative to each other. A restricting state of the restricting mechanism 30 is changeable because of relative movement of the seat 10 and the sleeve member 20, which is convenient to be operated.

The sleeve member 20 includes a rib 21 extending axially therefrom, and the seat 10 includes a mounting surface 11 facing toward the rib 21. One of a side of the rib 21 facing toward the mounting surface 11 and the mounting surface 11 has the at least one first restricting portion 31, and the other of the side of the rib 21 facing toward the mounting surface 11 and the mounting surface 11 has the at least one second restricting portion 32. In this embodiment, the sleeve member 20 further includes a flange 22 extending radially therefrom, and the rib 21 extends from the flange 22 so that the flange 22 is abuttable against a socket 2 to push the sleeve member 20 to move relative to the seat 10. However, the sleeve member may not have the flange, and the rib may integrally extend from and radially protrude beyond the sleeve member, which is also abuttable against the socket; the first and second restricting portion may be disposed on other positions of the seat and the sleeve member respectively. Specifically, the at least one first restricting portion 31 includes a guiding groove 311 which is closed loop, and the at least one second restricting portion 32 includes a restricting member 321 which is movably disposed within the guiding groove 311. The restricting member 321 is movable within the guiding groove 311 along the cycling path for smoothly operation. The at least one second restricting portion 32 preferably further includes a receiving groove 322 which is disposed on one of the sleeve member 20 and the seat 10, and the restricting member 321 is movably disposed within the receiving groove 322. In this embodiment, the rib 21 has the guiding groove 311 disposed thereon, and the receiving groove 322 is an elongate slot disposed on the mounting surface 11. The restricting member 321 is a bead which is movably disposed within the elongate slot. Therefore, when the seat 10 and the sleeve member 20 move relative to each other, the bead moves within the elongate slot and the guiding groove 311 along the cycling path, and the seat 10 and the sleeve member 20 are non-swingable relative to each other so that the seat 10 and the sleeve member 20 can smoothly and stably move along the axial direction. In other embodiments, the guiding groove may be disposed on the mounting surface and the receiving groove may be disposed on the rib.

Preferably, the guiding groove 311 includes a plurality of segments 312 transitionally connected with one another, and a bottom wall of the guiding groove 311 includes a plurality of stepped portions 313. Each of the plurality of stepped portions 313 is located between adjacent two of the plurality of segments 312 and includes a blocking surface 314 which faces toward a cycling direction D of the cycling path. In this embodiment, every adjacent two of the segments 312 have one of the plurality of stepped portions 313 disposed therebetween so that the blocking surface 314 ensures that the restricting member 321 moves unidirectionally on the cycling direction D and prevents the restricting member 321 from moving reversely.

The seat 10 includes a connecting portion 12 extending toward the sleeve member 20, and the sleeve member 20 includes a receiving hole 23 into which the connecting portion 12 is insertable and a neck portion 24 configured to be assembled with the socket 2. The neck portion 24 has an elastic arm 241 which is configured to be abutted against an engaging hole 200 in the socket 2. When the at least one second restricting portion 32 is located in the locking position, an outer periphery of the connecting portion 12 is radially abutted against the elastic arm 241 so that the elastic arm 241 is stably engaged within the engaging hole 200 and the socket 2 is stably assembled to the sleeve member 20. A diametric dimension of the connecting portion 12 is slightly smaller than a diametric dimension of the receiving hole 23 so that the connecting portion 12 is stably abuttable against the elastic arm 241 and the sleeve member 20 is smoothly and stably movable relative to the seat 10. Preferably, the seat 10 and the sleeve member 20 are respectively made in one piece, which has good structural integrity and is easy for manufacturing.

Figure 11:
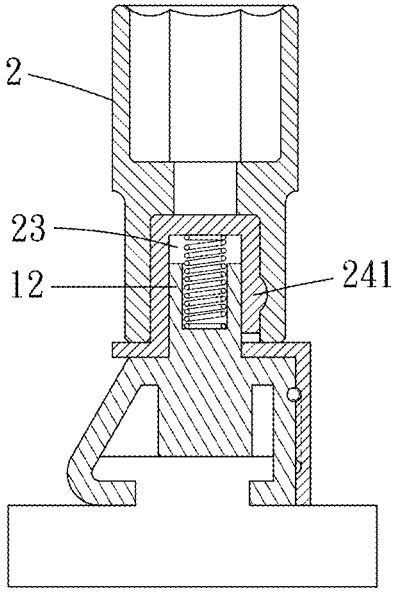
FIG. 11 is a cross-sectional view of the first preferable embodiment of the present invention in a locking position.
Figure 12:
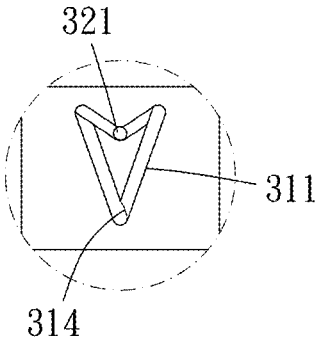
FIG. 12 is a state diagram of a restricting mechanism of FIG. 11.

The socket holder 1 further includes an elastic member 40 disposed between the seat 10 and the sleeve member 20, and the elastic member 40 biases the sleeve member 20 toward a direction away from the seat 10. Refer to FIGS. 7 to 12, during operation, the socket 2 is directly sleeved to the neck portion 24 and the elastic arm 241 is elastically abutted against the engaging hole 200. When the socket 2 is pressed along the axial direction to push the sleeve member 20, the sleeve member 20 compresses the elastic member 40 and the connecting portion 12 protrudes into the receiving hole 23, and the guiding groove 311 and the restricting member 321 move relatively. After stopping pressing the socket 2, the sleeve member 20 is biased by the elastic member 40, the guiding groove 311 and the restricting member 321 move relatively and the restricting member 321 is restricted in the locking position. The connecting portion 12 and the elastic arm 241 are abutted against each other so that the socket 2 is stably assembled to the socket holder 1, as shown in FIG. 11. When the socket 2 is pressed along the axial direction to push the sleeve member 20 again, the guiding groove 311 moves relative to the restricting member 321 and the restricting member 321 moves in the cycling direction D, the elastic member 40 biases the sleeve member 20 toward a direction away from the seat 10 after stopping pushing, and the guiding groove 311 moves relative to the restricting member 321 and the restricting member 321 is restricted in the releasing position. The connecting portion 12 is not abutted against the elastic arm 241 so as to release the socket 2, which is easy to be operated.

Figure 13:
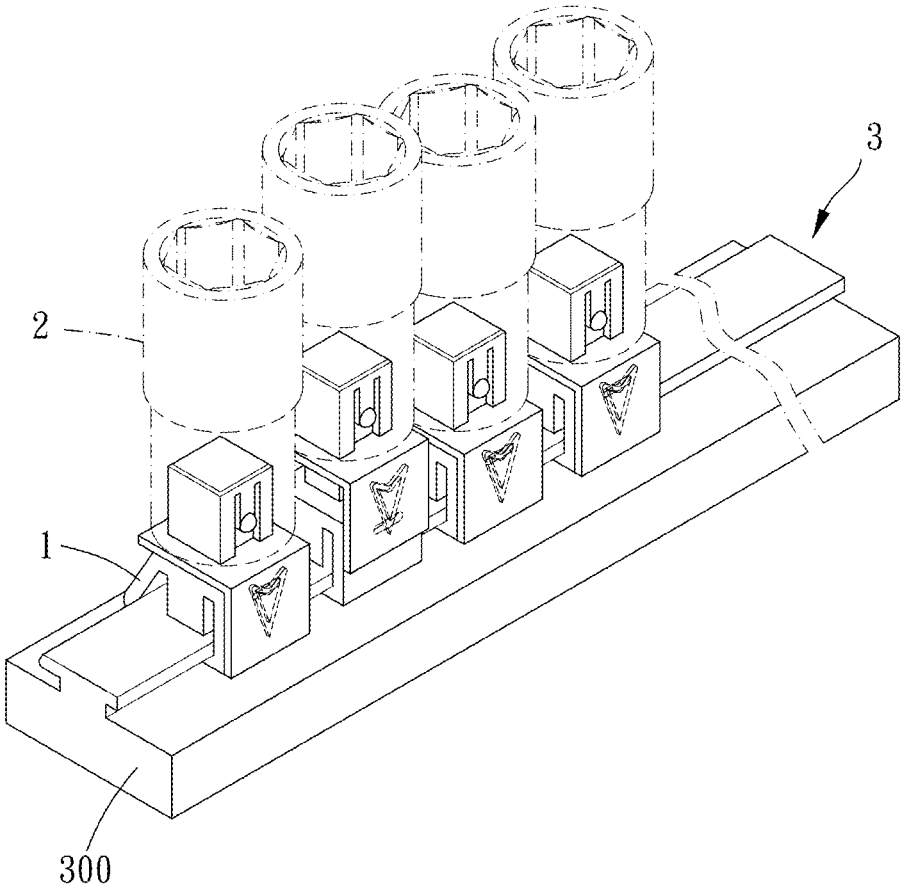
FIG. 13 is a schematic diagram of a socket rack of the first preferable embodiment of the present invention in use.
Figure 14:
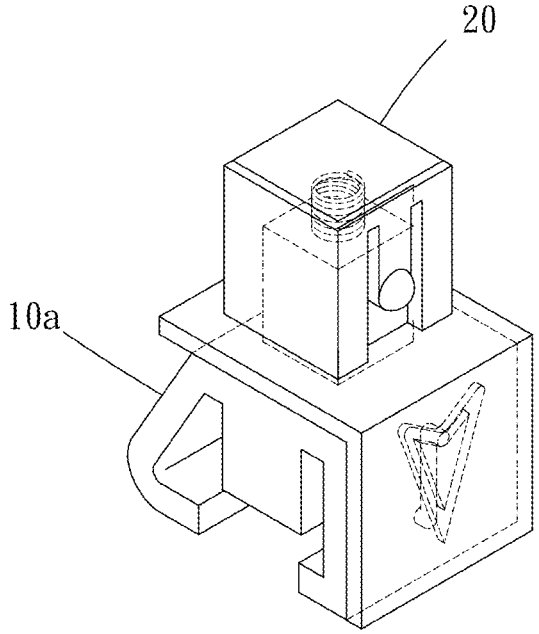
FIG. 14 is a stereogram of a second preferable embodiment of the present invention.
Figure 15:
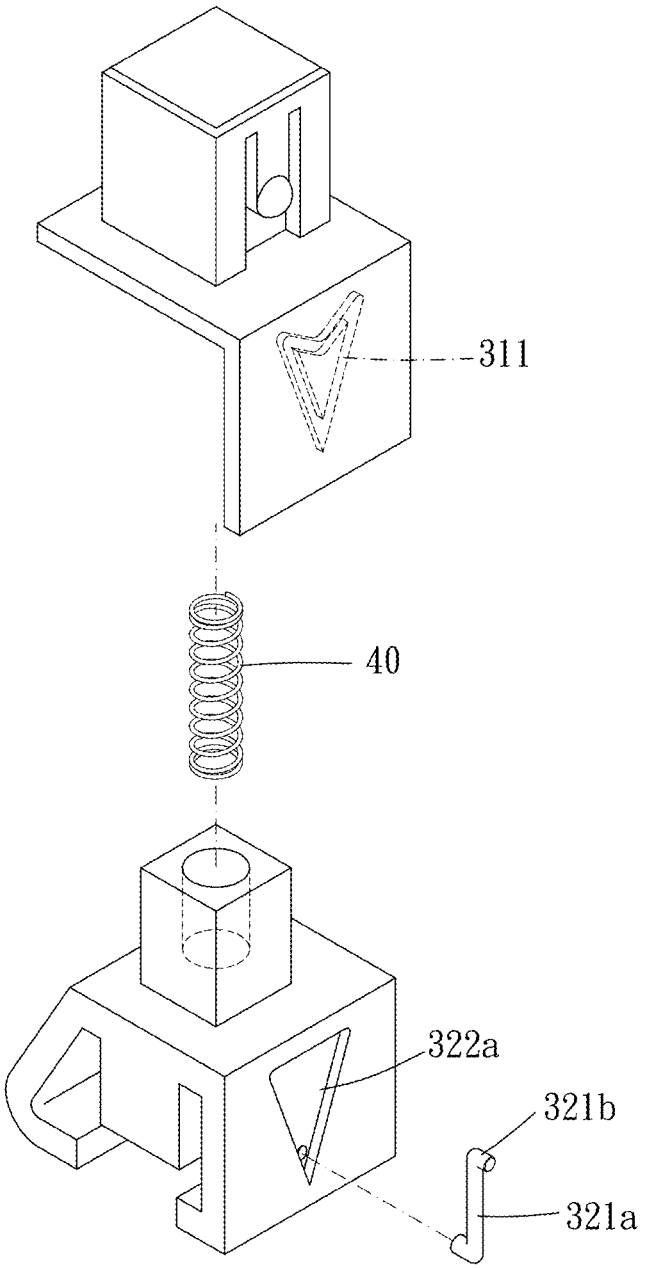
FIG. 15 is a breakdown drawing of the second preferable embodiment of the present invention.
Figure 16:
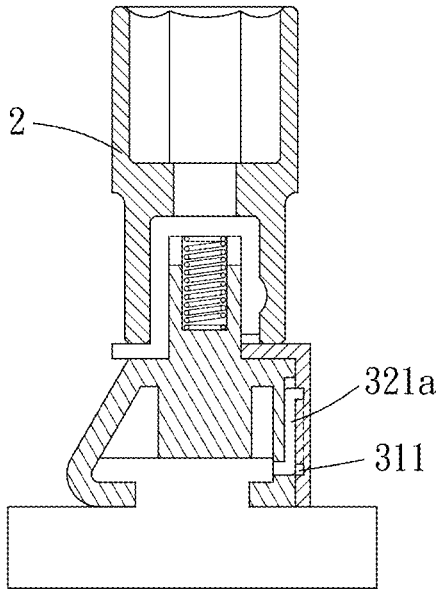
FIG. 16 is a cross-sectional view of the second preferable embodiment of the present invention in a locking position.
Figure 17:
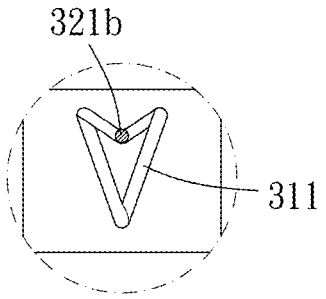
FIG. 17 is a state diagram of a restricting mechanism of FIG. 16.
Figure 18:
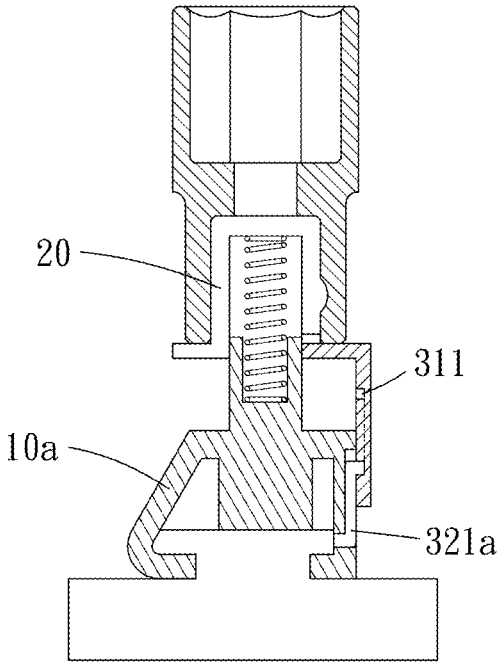
FIG. 18 is a cross-sectional view of the second preferable embodiment of the present invention in a releasing position.
Figure 19:
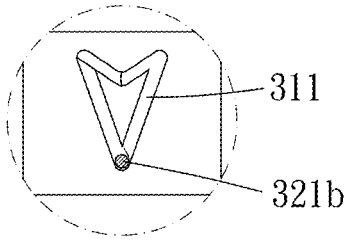
FIG. 19 is a state diagram of a restricting mechanism of FIG. 18.

A socket rack 3 is further provided, including at least one of the socket holder 1 as described above. The socket rack 3 further includes a sliding rail 300 on which the at least one socket holder 1 is slidably disposed. Preferably, the sliding rail 300 has a plurality of the socket holders 1, and each of the plurality of socket holders 1 is slidably disposed on the sliding rail 300, which can provide interval adjustment of any adjacent two of the plurality of socket holders 1, and the socket 2 can be locked to or released from the socket holder 1 by single hand. Furthermore, if one of the socket 2 is unlocked from one of the socket holder 1, the sleeving member 20 protrudes beyond the sleeving member 20 which is stably locked, as shown in FIG. 13, which is convenient to confirm whether the socket 2 is locked. However, the socket holder may be connected to a tool rack by insertion, screwing or any other ways.

Refer to FIGS. 14 to 19 which show a second preferred embodiment of the present invention. The restricting member 321*a* is Z-shaped and one end of the restricting member 321*a* is rotatably connected to a bottom wall of the receiving groove 322*a*, and another end 321*b* of the restricting member 321*a* movably protrudes into the guiding groove 311. When the sleeve member 20 and the seat 10 move close to each other, the restricting member 321*a* moves or swings along the cycling path, and the seat 10*a* and the sleeve member 20 do not swing relative to each other and smoothly move along the axial direction relative to each other. Preferably, a shape of the receiving groove 322*a* corresponds to an outer contour of the guiding groove 311, which restricts the restricting member 321*a* to swing within the receiving groove 322*a* for preferable operational stability. However, the restricting member may be directly inserted within the mounting surface without the receiving groove.

Figure 20:
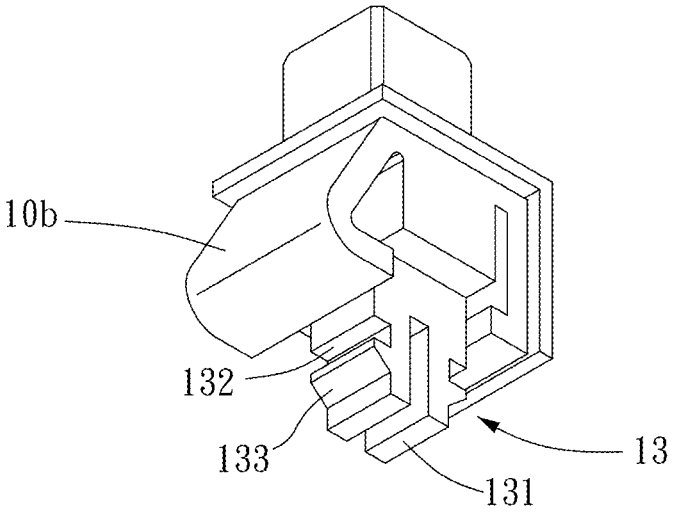
FIG. 20 is a stereogram of a third preferable embodiment of the present invention.
Figure 21:
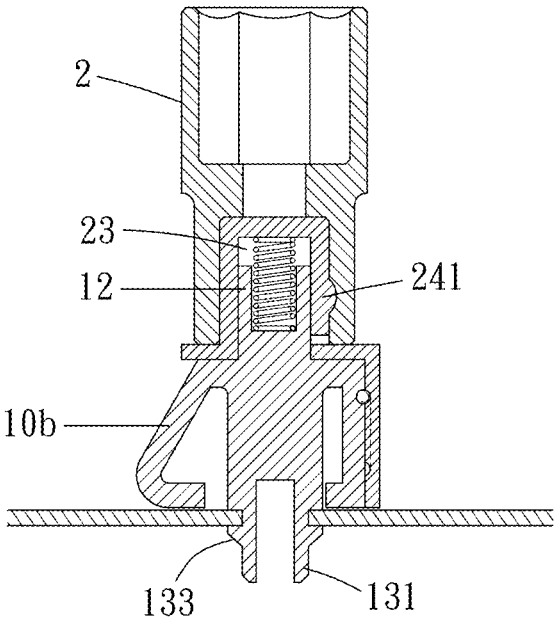
FIG. 21 is a cross-sectional view of the third preferable embodiment of the present invention in use.
Figure 22:
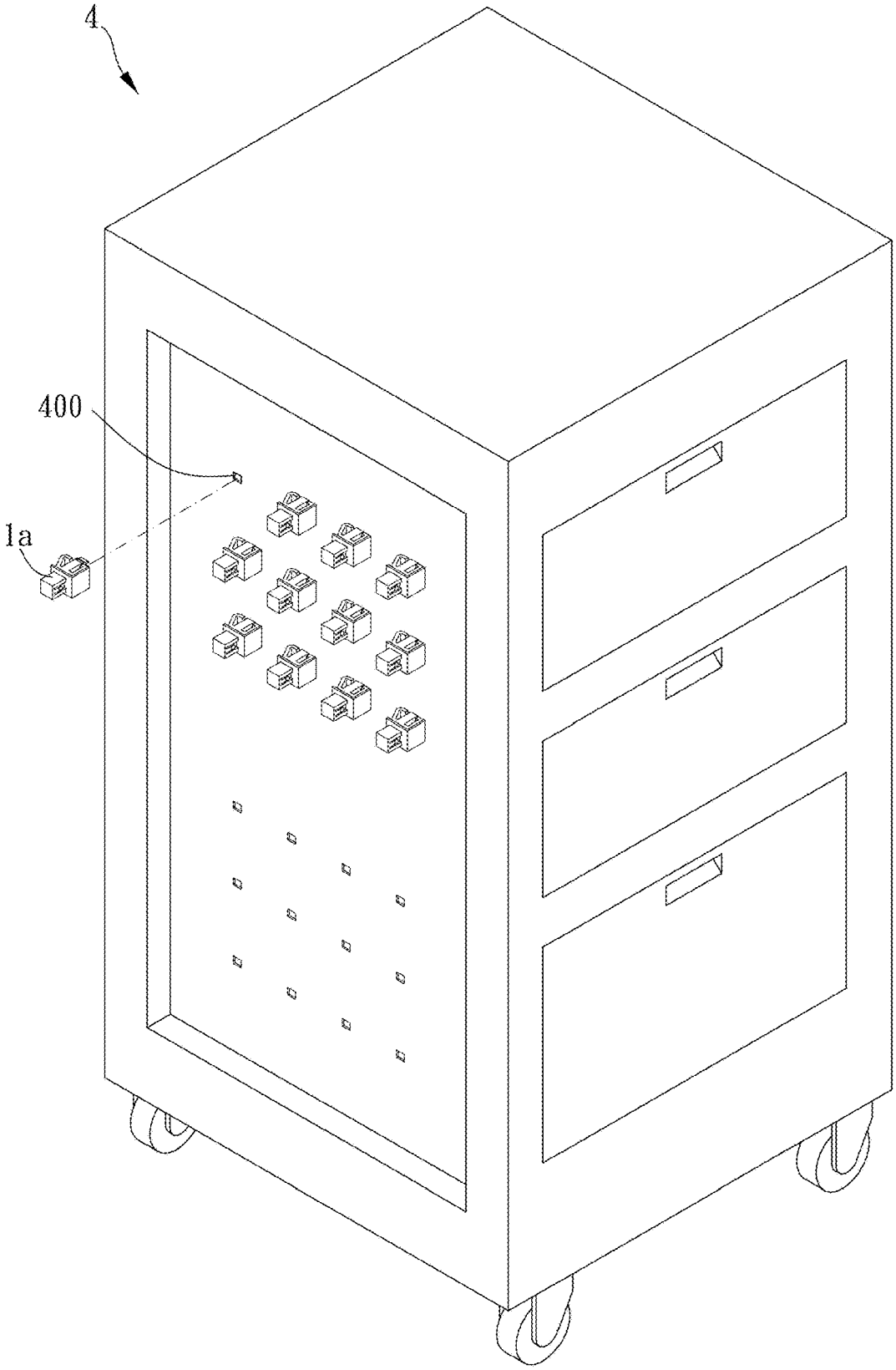
FIG. 22 is a schematic diagram of the third preferable embodiment of the present invention in use.

Refer to FIGS. 20 to 22 which show a third preferred embodiment of the present invention. A bottom of the seat

10*b* includes an insertion portion 13 extending downward, and the insertion portion 13 includes two arms 131 opposite to each other and two recessions 132 disposed respectively on the two arms 131. The two recessions 132 are configured to be engaged with a wall of an insertion hole 400 of a tool car 4 or a display rack. Therefore, the socket holder 1*a* is insertable within the hole 400 by the insertion portion 13. Each of the two arms 131 preferably has an inclined guiding surface 133 adjacent to the recessions 132 so as to be easy to be inserted to the insertion hole 400. Preferably, the two arms 131 which are elastically recoverable extend integrally from the seat 10*b*, and the seat 10*b* is releasable from the insertion hole 400 by pressing the two arms 131 close to each other, which is easy to be operated. However, the insertion portion may have a plurality of the arms or any other insertion structures to engage to the insertion hole.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A socket holder, including:

a seat;

a sleeve member, being movably assembled with the seat;

a restricting mechanism, including at least one first restricting portion and at least one second restricting portion which is movable relative to and positionably engaged with the at least one first restricting portion, one of the at least one first restricting portion and the at least one second restricting portion being disposed on the seat and the other being disposed on the sleeve member;

wherein when the seat and the sleeve member move relative to each other in an axial direction, the at least one second restricting portion unidirectionally moves along a cycling path relative to the at least one first restricting portion, and the at least one second restricting portion is restricted in a releasing position or a locking position.

2. The socket holder of claim 1, further including an elastic member elastically disposed between the seat and the sleeve member, and the elastic member biases the sleeve member toward a direction away from the seat.

3. The socket holder of claim 1, wherein the sleeve member includes a rib extending axially therefrom, the seat includes a mounting surface facing toward the rib, one of a side of the rib facing toward the mounting surface and the mounting surface has the at least one first restricting portion, and the other of the side of the rib facing toward the mounting surface and the mounting surface has the at least one second restricting portion.

4. The socket holder of claim 1, wherein the at least one first restricting portion includes a guiding groove which is closed loop, the at least one second restricting portion includes a restricting member which is movably disposed within the guiding groove, and the restricting member is movable within the guiding groove along the cycling path.

5. The socket holder of claim 4, wherein the guiding groove includes a plurality of segments transitionally connected with one another, a bottom wall of the guiding groove includes a plurality of stepped portions, each of the plurality of stepped portions is located between adjacent two of the plurality of segments and includes a blocking surface which faces toward a cycling direction of the cycling path.

6. The socket holder of claim 4, wherein the at least one second restricting portion further includes a receiving groove which is disposed on one of the sleeve member and the seat, and the restricting member is movably disposed within the receiving groove.

7. The socket holder of claim 6, wherein the receiving groove is an elongate slot, and the restricting member is a bead which is movably disposed within the elongate slot.

8. The socket holder of claim 6, wherein one end of the restricting member is rotatably connected to a bottom wall of the receiving groove, and another end of the restricting member movably protrudes into the guiding groove.

9. The socket holder of claim 1, wherein the seat includes a connecting portion extending toward the sleeve member, the sleeve member includes a receiving hole into which the connecting portion is insertable and a neck portion configured to be assembled with a socket, the neck portion has an elastic arm which is configured to be abutted against an engaging hole in the socket; when the at least one second restricting portion is located in the locking position, an outer periphery of the connecting portion is radially abutted against the elastic arm.

10. The socket holder of claim 7, wherein the seat and the sleeve member are respectively made in one piece; the socket holder further includes an elastic member disposed between the seat and the sleeve member, and the elastic member biases the sleeve member toward a direction away from the seat; the sleeve member includes a rib extending axially therefrom, the seat includes a mounting surface facing toward the rib, one of a side of the rib facing toward the mounting surface and the mounting surface has the at least one first restricting portion, and the other of the side of the rib facing toward the mounting surface and the mounting surface has the at least one second restricting portion; the sleeve member further includes a flange extending radially therefrom, and the rib extends from the flange; the guiding groove includes a plurality of segments transitionally connected with one another, a bottom wall of the guiding groove includes a plurality of stepped portions, each of the plurality of stepped portions is located between adjacent two of the plurality of segments and includes a blocking surface which faces toward a cycling direction of the cycling path; the seat further includes a connecting portion extending toward the sleeve member, the sleeve member further includes a receiving hole into which the connecting portion is insertable and a neck portion configured to be assembled with a socket, the neck portion has an elastic arm which is configured to be abutted against an engaging hole in the socket; when the at least one second restricting portion is located in the locking position, an outer periphery of the connecting portion is radially abutted against the elastic arm; a diametric dimension of the connecting portion is slightly smaller than a diametric dimension of the receiving hole.

11. A socket rack, including at least one socket holder of claim 1, the socket rack further including:

a sliding rail on which the at least one socket holder is slidably disposed.

* * * * *